US005998109A

United States Patent [19]

Hirabayashi

[11] Patent Number: 5,998,109

[45] Date of Patent: Dec. 7, 1999

[54] METHOD FOR A SILVER HALIDE LIGHT-SENSITIVE PHOTOGRAPHIC MATERIAL AND DEVELOPMENT READING METHOD

[75] Inventor: Shigeto Hirabayashi, Hino, Japan

[73] Assignee: Konica Corporation, Tokyo, Japan

[21] Appl. No.: 09/217,560

[22] Filed: Dec. 21, 1998

[30] Foreign Application Priority Data

Dec. 24, 1997 [JP] Japan ..... 9-366468
Mar. 11, 1998 [JP] Japan ..... 10-078381

[51] Int. Cl.[6] ..... G03C 5/29

[52] U.S. Cl. ..... 430/434; 430/363; 430/367; 430/404; 430/419

[58] Field of Search ..... 430/363, 367, 430/419, 434, 404

[56] References Cited

U.S. PATENT DOCUMENTS 4,056,392 11/1977 Scott ..... 430/228
5,627,016 5/1997 Manico ..... 430/434
5,698,382 12/1997 Nakahanada et al. ..... 430/434

FOREIGN PATENT DOCUMENTS 0 403 850 12/1990 European Pat. Off. .

OTHER PUBLICATIONS

L.F.A. mason, "Photographic Processing Chemistry", 1979, pp. 157–162 and 174–177; London, XP 002096880.

*Primary Examiner*—Hoa Van Le
*Attorney, Agent, or Firm*—Frishauf, Holtz, Goodman, Langer & Chick, P.C.

[57] ABSTRACT

A method for developing a silver halide photographic light-sensitive material, wherein a silver halide photographic light-sensitive material containing at least three mosaic-like or stripe-like filter layers having different spectral transmission characteristics and at least one silver halide emulsion layer is exposed, thereafter said silver halide photographic light-sensitive material is processed by coating a processing solution or spraying a processing solution which consists of a developer containing at least one developing agent.

4 Claims, No Drawings

METHOD FOR A SILVER HALIDE LIGHT-SENSITIVE PHOTOGRAPHIC MATERIAL AND DEVELOPMENT READING METHOD

FIELD OF THE INVENTION

This invention relates to a development of a silver halide photographic light-sensitive material and a reading method for a developed silver halide photographic light-sensitive material, particularly relates to development and a developing reading method for a silver halide photographic light-sensitive materia containing at least three mosaic-like or stripe-like filter layers having different spectral transmission characteristics and silver halide emulsion layer.

BACKGROUND OF THE INVENTION

In recent years, as a silver halide photographic light-sensitive material to obtain color print, color negative film is mainly used. After shooting with color negative film, the color negative film is developed, thus obtained image is printed to color paper and then color print is obtained. The above described method is widely employed.

This method has an advantage that a high quality of color print is obtained. However, as both development of color negative film and development of color paper need complex processing processes, it takes not less than 20 min. to obtain color print from after shooting with color negative film. Therefore, in rapid processing there exists a big problem.

On the other hand, with respect to a digital camera which is recently very popular, because photographed image information is recorded as digital information it is possible to obtain hard copy (print) in a few minutes by an optimal means. However, with respect to the digital camera generally used with not more than 1,000,000 of picture elements, the quality of the print is not sufficient yet now.

Therefore, development of a system in which digitized image information and color print of high quality are obtained rapidly using silver halide photographic light-sensitive material without any complex processing processes.

The methods to read image information by a scanner rapidly after the development of silver halide photographic light-sensitive material are described in Japanese Patent Publication Open to Public Inspection (hereinafter referred to as JP-A) Nos. 5-100321, 9-121265, 9-146247, 9-230557, 9-281675, and U.S. Pat. Nos. 5,101,286, 5,113,351, 5,627,016. But these methods are insufficient in stability and rapidity of the process.

SUMMARY OF THE INVENTION

The first object of the invention is to provide the development method of the silver halide photographic light-sensitive material extremely in a short time after picture-taking, wherein the image is obtained as a digitized information. The second object of the invention is to provide the reading method of the digitized information. Furthermore, another object of the invention is to provide the developing method and the reading method of the silver halide photographic light-sensitive material by which color hard copy (color print) is obtained extremely in a short time after picture-taking.

DETAILED DESCRIPTION OF THE INVENTION

Above object of the invention could be attained by the following methods (item 1 to 15).

1. A method for processing a silver halide photographic light-sensitive material containing at least one silver halide emulsion layer and mosaic-like or stripe-like filter layer having at least three spectral transmission characteristics comprising the step of exposing the silver halide emulsion layer, and developing the exposed silver halide emulsion layer by coating or spraying a processing solution containing at least one developing agent so as to obtain a developed image.

2. The method of item 1, further comprising:

scanning the developed image, and converting the developed image into a digital information.

3. The method of item 1, wherein the processing solution contains at least one fixing agent.

4. The method of item 2, wherein the processing solution contains at least one fixing agent.

5. The method of item 2, wherein the processing solution contains at least a base and/or base precursor.

6. The method of item 2, wherein the processing solution contains at least a base and/or base precursor and at least a fixing agent.

7. The method of item 2, wherein the silver halide photographic light-senshtive material is processed by heating up to not less than 80° C.

8. A method for processing a silver halide photographic light-sensitive material using an alkaline solution after exposing imagewise, wherein the silver halide photographic light-sensitive material contains at least three mosaic-like or stripe-like filter layers having different spectral transmission characteristics and at least one silver halide emulsion layer containing at least one developing agent.

9. A method for processing the silver halide photographic light-sensitive material using an alkaline solution containing at least one fixing agent after exposing imagewise, wherein the silver halide photographic light-sensitive material contains at least three mosaic-like or stripe-like filter layers having different spectral transmission characteristics and at least one silver halide emulsion layer containing at least one developing agent.

10. A method for processing the silver halide photographic light-sensitive material using an alkaline solution and thereafter piling a processing sheet containing at least one fixing agent on it after exposing imagewise, wherein the silver halide photographic light-sensitive material contains at least three mosaic-like or stripe-like filter layers having different spectral transmission characteristics and at least one silver halide emulsion layer containing at least one developing agent.

11. A method for processing the silver halide photographic light-sensitive material using a solution containing at least one base precursor after exposing imagewise, wherein the silver halide photographic light-sensitive material contains at least three mosaic-like or stripe-like filter layers having different spectral transmission characteristics and at least one silver halide emulsion layer containing at least one developing agent and one basic metal compound.

12. A method for processing the silver halide photographic light-sensitive material using a solution containing at least one base precursor and at least one fixing agent after exposing imagewise, wherein the silver halide photographic light-sensitive material contains at least three mosaic-like or stripe-like filter layers having different spectral transmission characteristics and at least one silver halide emulsion layer containing at least one developing agent and at least one basic metal compound.

13. A method for processing the silver halide photographic light-sensitive material using a solution containing at least one base precursor and thereafter piling a processing sheet containing at least one fixing agent on it after exposing imagewise, wherein the silver halide photographic light-sensitive material contains at least three mosaic-like or stripe-like filter layers having different spectral transmission characteristics and at least one silver halide emulsion layer containing at least one developing agent and at least one basic metal compound.

14. A method for processing the silver halide photographic light-sensitive material by piling a processing sheet containing at least one base precursor and at least one fixing agent on it after exposing imagewise, wherein the silver halide photographic light-sensitive material contains at least three mosaic-like or stripe-like filter layers having different spectral transmission characteristics and at least one silver halide emulsion layer containing at least one developing agent and at least one basic metal compound.

15. A development reading method for the silver halide photographic light-sensitive material, wherein after processing by using any of the methods of item 1 to item 7, the obtained image is read by a scanner and converted into a digital information.

The sensitivity of the silver halide photographic light-sensitive material according to the invention is preferably not less than ISO 30, more preferably not less than ISO 100, especially preferably not less than ISO 400.

In this invention, it is preferable to develop the light-sensitive material by a spraying developing solution (for example, ink-jet development) or a pasting developing solution substantially in an amount required for the developing solution only to soak into the light-sensitive material. There is no limitation with the method of spraying the developing solution. Both spraying the developing solution by moving a single movable nozzle and spraying the developing solution with fixed plural nozzles are employed. Spraying the developing solution to the fixed light-sensitive material by moving a nozzle may be employed and spraying the developing solution from a fixed nozzle to the movable light-sensitive material may be also employed. Combined usage of the above mentioned methods can be employed.

In the present invention, the image formed in the light-sensitive material is read with a scanner etc. (CCD camera is also employed) and converted into digital information which is recorded in other recording medium. Here the scanner is an apparatus which can optically scan the light-sensitive material and convert reflective or transmission optical density into image information. When scanning, it is general and recommended to scan a necessary region of the light-sensitive material by moving an optical portion of the scanner in different direction against the moving direction of the light-sensitive material. Moving only the optical portion of the scanner while the light-sensitive material being fixed and moving only the light-sensitive material while the optical portion of the scanner being fixed are employed. Combined usage of the above mentioned methods can be employed.

As a light source for reading the image information are used a tungsten lamp, a fluorescent lamp, an emission diode and a laser light without limitation for using them. From the viewpoint of low cost the tungsten lamp is preferred and from the view point of stability and high luminance the laser light (coherent light) is preferred. There is no limitation in the reading method, but from the view point of sharpness to read the transmission light is preferred.

Applying a thermal developing method to the method of the present invention is preferred in that a processing time is shortened and an environmental aspect is improved. Incorporating developer or developer precursor in the silver halide photographic light-sensitive material according to the present invention is preferred in that controlling developing solution is easier.

Next, the invention will be explained in detail. First, at least three mosaic-like or stripe-like filter layers having different spectral transmission characteristics used in the silver halide photographic light-sensitive material according to the present invention will be explained.

With respect to preparing the filter layers according to the present invention, a method by using dyed starch particle, a method by forming stripe-like or mosaic-like pattern by printing, a method by thermal transfer, a method by ink-jet. a method by photoresist (photohardening resin), a method by photography, a method by color liquid crystal display element and color CCD picture-taking element etc. can be employed. These methods were described in JP-A No. 55-6342, 63-261361, 5-127016, 6-100811, 7-294714, 8-22108, 9-185077, 9-145909, 9-178925.

With respect to the spectral transmission characteristics of the filter layers according to the present invention, combined usage of Y (yellow), M (magenta) and C (cyan) which are three primary colors of light in substructive color system and combined usage of B (blue), G (green) and R (red) which are three primary colors of light in additive color system are preferred. Besides them black matrix can be optionally used.

With respect to the pattern of the filter layers according to the present invention, any of the stripe-like pattern and the mosaic-like pattern can be used, but the mosaic-like pattern having irregular and random disposition is more preferable.

With respect to the size of the filter layers according to the present invention, in the case of stripe-like filter layer, 1 to 50 $\mu$m in width is preferable, 2 to 20 $\mu$m is more preferable. In the case of mosaic-like filter layer, 0.1 to 20 $\mu$m in one unit area is preferable, 0.5 to 10 $\mu$m is more preferable. With respect to the thickness of the color filter layers, in the case of both stripe-like filter layer and mosaic-like filter layer, 1 to 50 $\mu$m is preferable, 2 to 20 $\mu$m is more preferable.

Next, the silver halide emulsion according to the present invention will be explained.

Any shape of the silver halide grain contained in the silver halide emulsion used in the present invention may be employed. For example, can be employed the grain having the regular crystal structure such as cubic form, an octahedral form and tetradecahedral form, or the grain having the irregular crystal structure such as tabular form. Among them high sensitivity tabular silver halide grain is preferably used. With respect to composition of silver halide, AgCl, AgClBr, AgClBrI, AgClI are optionally used, but for a rapid process, silver chloroiodobromide having sufficient chloride content and insufficient. iodide content is preferred. The particle size of the silver halide grains is preferably 0.01 to 1.0 $\mu$m. In order to obtain high optical density, 0.05 to 0.6 $\mu$m is more preferable.

The tabular silver halide grain used in the present invention is described in U.S. Pat. Nos. 4,439,520, 4,425,425, 4,414,304 and obtained easily. The tabular silver halide grain may be the silver halide grain which is allowed to grow epitaxially or to be shelled by supplying silver halide containing different composition onto specified surface portion.

The tabular silver halide grain having aspect ratio of 2 to 16, which occupies not less than 50% of the total projected area of all the silver halide grains contained in the emulsion is preferable. The tabular silver halide grain having aspect ratio of not less than 16 is not preferable because it's pressure resistance is not acceptable. As the content of the tabular silver halide grain occupies 60 to 70%, preferable result is obtained. And as the content of the tabular silver halide grain occupies not less than 80%, more preferable result is obtained.

The aspect ratio means the ratio of the diameter of the circle which has the same area as the projected area of the tabular grain to the thickness formed with two major parallel planes of the tabular grain.

The tabular grain which contains much silver chloride content is referred to the method described in U.S. Pat. No. 5,320,938.

It is preferable for the silver halide grain to contain high silver iodide of 0.001 to 10 mol % existing portion or silver nuclei in it's interior, because pressure resistance is improved.

To prepare the silver halide emulsion of this invention can be applied any one of acidic precipitation, neutral precipitation and ammoniacal precipitation. When a metal is doped to adjust sensitivity and contrast, it is preferable that grain formation is carried out under the acidic condition of pH 1 to 5.

To control the growth of the tabular grain, a silver halide solvent such as an ammonia, a thioether, a thiourea and a thione compound can be used.

It is preferable to add a metal atom of V group to VIII group in a periodic table in an amount of $1\times10^{-8}$ to $1\times10^{-3}$ per mole of silver while physical ripening or chemical ripening, especially to dope iridium in an amount of $1\times10^{-8}$ to $1\times10^{-3}$ is often carried out in preparing silver halide emulsion and can be applied to the present invention. In order to obtain gamma ($\gamma$) of not less than 10, it is preferable to dope a transition metal compound such as rhodium, ruthenium, osmium and rhenium etc. in an amount of $1\times10^{-8}$ to $1\times10^{-3}$ . The transition metal compound such as rhodium, ruthenium, osmium and rhenium etc. is preferably added in the course of forming silver halide grain. These compounds may be added uniformly throughout the grain or added locally at core portion or shell portion of core/shell structure grain. Adding these compounds dominantly at shell portion is preferred.

Silver halide emulsion can be sensitized with noble metal salts such as auric salt by using singly or in combination. Sensitizing with the noble metal salts in the presence of later mentioned sensitizing dyes result in higher sensitization. The fine particle dispersion method for these noble metal salts together with sensitizing dyes also results in higher sensitization. If fine particle dispersed AgI is added in the course of chemical ripening, AgI is formed on the surface of silver grain and thereby the effect of sensitization by sensitizing dye is higher.

Chemical sensitized silver halide grain can be spectrally sensitized. As a preferable spectral sensitizing dye is cited a cyanine, a carbocyanine, a dicarbocyanine, a complex cyanine, a styryl dye, a merocyanine, a complex merocyanine and a holopolar dye. The spectral sensitizing dye used in the art can be used singly or in combination. Especially useful ones are a cyanine, a merocyanine and a complex merocyanine. These spectral sensitizing dyes contain any of basic heterocyclic nuclei which are usually applied to cyanine dyes. That is, a prroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus and the nuclei obtained by alicyclic hydrocarbon ring being fused to these nuclei and the nuclei obtained by aromatic hydrocarbon ring being fused to these nuclei, namely, an indolenine nucleus, a benzindolenine nucleus, an indole nucleus, a benzoxazole nucleus, a naphthoxazole nucleus, a bebzothiazole nucleus, a naphthothiazole nucleus, a benzoselenazole nucleus, a benzimidazole nucleus and a quinoline nucleus are cited. These nuclei may be substituted by any substituent on their carbon atom.

As a ketomethylene nucleus, a 5,6-membered heterocyclic nucleus such as a pyrazoline-5-one nucleus, a thiohydantoin nucleus, a 2-thiooxazolidine-2,4-dione nucleus, a thiazolidine-2,4-dione nucleus, a rhodanine nucleus and a thiobarbituric acid nucleus can be applied to the merocyanine or the complex merocyanine.

The sensitizing dye may be used singly or in combination. Combined usage of the sensitizing dyes are often carried out for the purpose of supersensitization.

Various kinds of the photographic additives used in the present invention are dissolved in an aqueous solution or organic solvent for use of them. In case where these additives are insoluble in an aqueous solution, fine grain crystals of these additives are dispersed in an aqueous solution, gelatin, hydrophilic or hydrophobic polymer for use of them. In this invention dyestuff, dye, desensitizing dye, hydrazine, redox compound, antifoggant and UV absorber etc. can be dispersed by known dispersion mills (homogenizers). For example, are cited ball mill, sand mill, colloid mill, ultrasonic homogenizer and high speed impeller homogenizer.

Thus dispersed photographic additives are fine grains having average particle diameter of not more than 100 $\mu$m. The fine grains whose average particle diameter is 0.02 to 10 $\mu$m are usually used. With respect to dispersion methods, the following methods are recommended; (i) a method by stirring mechanically the additives at high speed (JP-A 58-105141), (ii) a method by dissolving the additives in organic solvent by heating, and adding thus obtained solution to gelatin or hydrophilic polymer aqueous solution containing surfactant and defoaming agent to be dispersed, thereafter removing the organic solvent (JP-A 44-22948), (iii) a method by dissolving the additives in an acid solution such as citric acid, acetic acid, sulfuric acid, hydrochloric acid and malic acid etc., thereafter thus obtained solution being poured into polymer aqueous solution of pH 4.5 to 7.5 resulting in producing fine crystal precipitation dispersion (JP-A 50-80119), (iv) a method by dissolving the additives in an alkaline aqueous solution consisting of sodium hydroxide, sodium hydrogencarbonate or sodium carbonate, thereafter thus obtained solution being poured into polymer (such as gelatin etc.) aqueous solution of pH 4.5 to 7.5 resulting in producing fine crystal precipitation dispersion (JP-A 2-15252).

The examples of developing agents used in the silver halide photographic material according to the present invention are hydroquinone derivatives such as hydroquinone, sodium hydroquinonesulfonate and chlorohydroquinone. Besides the hydroquinone derivatives, superadditive developing agents are used. The examples of the superadditive developing agents are pyrazolidone derivatives such as 1-phenyl-3-pyrazolidone, 1-phenyl-4,4-dimethyl-3-pyrazolidone, 1-phenyl-4-methyl-4-hydroxymethyl-3-pyrazol-idone and 1-phenyl-4-methyl-3-pyrazolidone, and N-methyl-p-aminophenol sulfuric acid salt. Developing agent and superadditive developing agent can be used in combination. In place of hydroquinone, reductone derivatives such as ascorbic acid and iso-ascorbic acid can be used in combination with above mentioned superadditive developing agent.

As a preserving agent according to the invention is cited sodium sulfite, potassium sulfite and potassium carbonate.

As a chelating agent is cited EDTA, EDTA 2Na, EDTA 4Na, and as a antifoggant or antisludging agent is cited 5-methylbenzotriazole, 2-mercaptobebzothiazole, 1-phenyl-5-mercaptotetrazole, 6-nitrobenzimidazole, 1-(4-sulfophenyl)-5-mercaptotetrazole, 2-mercaptobenzimidazole, 2-mercapto-5-sulfobenzimidazole, 2-mercapto-4-hydroxypyridine and 2-mercapto-4-hydroxy-5,6-dimethylpyrimidine.

As a development accelerator is cited di-ethanolamine, tri-ethanolamine and di-ethylaminopropanediol. As a antifoggant used in developer, an inorganic or organic antifoggant can be used. The pH of developing solution can be adjusted in the range of 9 to 12 with alkaline agent such as sodium hydroxide and potassium hydroxide etc. From the viewpoint of reservation of developer, the pH of developing solution is preferably 10±0.5, but the pH of developing solution is preferably 11±0.5 for the purpose of rapid development.

Next, the silver halide photographic light-sensitive material containing developing agent will be explained.

Conventional silver halide can be used in the present invention. As a useful silver halide, silver chlorobromide containing not less than 60 mol % of silver chloride is preferred, and silver chlorobromide containing not less than 80 mol % of silver chloride is more preferred. To reduce a load of fixation and to improve graininess of image, particle diameter is preferably smaller and coated amount of silver is preferably less. Preferable particle diameter of silver halide is not more than 0.3 μm, and not more than 0.16 μm is more preferable.

As a hydrophilic binder, binder used in conventional silver halide photographic light-sensitive material can be used. Preferable binder is a gelatin or a synthesized polymer, more preferable binder is an alkali processed gelatin or an acid processed gelatin whose molecular weight is 4,000 to 1,000,000.

As a developing agent is cited butyl gallate, hydroauinone, hydroquinone substituted by halogen atom or alkyl group, hindered phenol derivative, catechol derivative and ascorbic acid derivative.

As an aqueous solution insoluble basic compound is cited oxide, hydroxide and basic carbonate of zinc or alminium. Preferable ones are zinc hydroxide, zinc oxide and basic carbonate.

A metal compound which is insoluble in an aqueous solution can be used in the form of fine grain whose average particle diameter is 0.01 to 10 μm to be dispersed in hydrophilic binder.

As a complex forming compound (or a base precursor) which can release hydroxide ion by reaction with basic compound, known chelating agent in analytical chemistry and known water softening agent in photographic chemistry are used. As the complex forming compound preferable in this invention are ethylenediaminetetraacetic acid, nitorilotriacetic acid, diethylenetriaminepentaacetic acid, ethylenediaminetetramethylenephosphonic acid, pyridinecarboxylic acid, and pyridine-2,6-dicarboxylic acid. Especially preferable one is pyridinecarboxylic acid.

As a fixing agent according to the invention, known silver halide solvent can be used, for example are cited sodium thiosulfate, ammonium thiosulfate, potassium thiocyanate, mercaptoazole derivative and hydantoin derivative.

The supplied amount of the processing solution (including an alkaline solution and a solution containing at least one base precursor described in item 8 to 13) according to the invention is preferably 0.01 to 50 g per $m^2$ of the silver halide photographic light-sensitive material, more preferably 1 to 20 g. To supply less amount of developing solution and fixing solution, it is preferred to supply them in the form of droplet, curtain membrane and slit membrane in stead of accumulated tank solutions. Spraying the droplet of 1 to 100 μm in size from capillary is carried out by utilizing heat or vibration. Slit supply is carried out by supplying processing solution from the slit of optionally decided length and 1 to 100 μm in width. The processing solution may be supplied under an ordinary pressure or a reduced pressure by vacuum pump.

As a water, generally used water is available, for example, distilled water, mineral water, well water and water works water can be used. The water can contain low boiling solvent, surfactant, antifoggant and antifungal agent.

Amount of water supplied to the light-sensitive material is in the range of 0.1 to 5 g/$m^2$, preferably in the range of 10 to 200% of required amount for coated layer to swell, temperature of water supplied to the light-sensitive material is in the range of 20 to 60° C., therefore room temperature is applied.

With respect to a method for heating the silver halide photographic light-sensitive material, to contact it with a heat plate, a heat roller, a heat dram, an infra redray lamp heater etc. or pass over it through the heat atmosphere generated by above mentioned means.

Next, the thermal development photographic light-sensitive material according to the present invention will be explained.

As an organic silver salt, silver salt of long chain fatty acid is preferable. Number of carbon atom of carbon chain of fatty acid is 2 to 30. Preferable organic silver salts are silver behenate, silver stearate, silver create, silver laurate, silver caprate, silver myristate, silver palmitate, silver maleate, silver fumarate, silver tartrate and combined usage of these organic silver salts is available. Further, silver organic carboxylate which is substituted on it's carbon atom with a hydroxy group, a halogen atom and an amino group etc. is also available.

The organic silver salt used in the present invention is dispersed with reducing agent, stabilizer and antifoggant etc. in a hydrophobic or hydrophilic binder and then coated on a support. The organic silver salt is optionally used together with light-sensitive silver halide.

Examples of binders are cited polyvinyl acetal, polyvinyl chloride, polyvinyl acetate, cellulose acetate, polyolefin, polyester, polystyrene, polyacrylonitrile, polycarbonate, polybutyral, alkali processed gelatin, acid processed gelatin, phthalated gelatin and phenylcarbazinated gelatin.

Examples of reducing agents are cited hydroquinone derivatives such as hydroquinone, chlorohydroquinone, and 2,5-dimethylhydroquinone, catechol derivatives such as 4-methyl-catechol and 4-methoxy-catechol, pyrogallol derivatives such as methyl gallate and butyl gallate, pyrazolidone derivatives such as 1-phenyl-3-pyrazolidone and 1-phenyl-4-hydroxymethyl-3-pyrazolidone.

As an antifoggant and a stabilizer, is cited known benzotriazole derivative, imidazole derivative, azaindane derivative, thiazolium salt derivative, urazole derivative and thiuronium derivative. Especially useful one is mercury derivative. Mercurous acetate and mercurous bromide are preferable.

The thermal development photographic light-sensitive material exposed imagewise, thereafter it is processed by heat development. Heating the thermal development photographic light-sensitive material is carried out by contacting it with a heat plate, a heat roller, a heat dram, an infra redray lamp heater etc. or pass over it through the heat atmosphere generated by above mentioned means.

Developing temperature according to the invention is in the range of room temperature of 25±5° C. to 200° C., preferable developing time is 0.1 to 30 sec. more preferably 1 to 20 sec.

The supplied amount of the processing solution according to the invention is preferably 0.01 to 50 g per $m^2$ of the silver halide photographic light-sensitive material, more preferably 1 to 20 g. To supply less amount of developing solution and fixing solution, it is preferred to supply them in the form of droplet, curtain membrane and slit membrane in stead of accumulated tank solutions. Spraying the droplet of 1 to 100 μm in size from capillary is carried out by utilizing heat or vibration. Slit supply is carried out by supplying processing solution from the slit of optionally decided length and 1 to 100 μm in width. The processing solution may be supplied under an ordinary pressure or a reduced pressure by vacuum pump.

(Spraying method and costing method)

With respect to the spraying development method of claim 1 in the present invention, is cited a method by spraying the droplet utilizing the vibration of piezo electricity element (for example, piezo electricity ink-jet head etc.), a method by spraying the droplet using thermal head utilizing bumping, and a method by spraying the processing solution utilizing air pressure or liquid pressure.

With respect to the coating development method is cited an air doctor coater, a blade coater, a rod coater, a knife coater, a squeeze coate, an immersion coater, a reverse roller coater, a transfer roller coater, a curtain coater, a double roller coater, a slide hopper coater, a gravure coater, a kiss roll coater, a bead coater, a cast coater, a spray coater, a colander coater and an extrusion coater. Especially preferable ones are a gravure coater, an immersion coater, a bead coater and a blade coater.

(Heating means)

With respect to claim 7 in the preset invention, the temperature of the light-sensitive material heated by heat means is preferably not: less than 80° C., more preferably not less than 85° C., especially preferably not less than 90° C. and the temperature of the light-sensitive material is not more than 150° C. from the viewpoint of the heat resistance of the light-sensitive material and development control.

As to heating means to heat the light-sensitive material, is cited a conductive heating method for contacting the light-sensitive material with heat dram and heat belt, a convective heating method for heating the light-sensitive material by heat convection generated by dryer etc., and a emissive heating method for heating the light-sensitive material by emission of infra redray and high frequent electromagnetic waves.

In the case of the conductive heating method, to prevent an undesirable affection to the emulsion layer of the processed light-sensitive material, a heat source is preferably contacted with the light-sensitive material from the back surface.

As a processing sheet described in item 10, 13 and 14, the processing sheet described in JP-A 9-258402 page 18–19 is preferably used. As a fixing agent used for the processing sheet is cited thiosulfate salt, sufite salt, thiocyanate salt, thioether compound, nitrogen containing heterocyclic compound having sulfid group described in JP-A 4-365037 page 11–21, JP-A 5-66540 page 88–92, meso-ion compound, uracil compound and hydatoin compound.

The processing sheet may contain physical development nuclei which can fix dissolved silver halide during processing.

The physical development nuclei can reduce silver halide which is dissolved in the light-sensitive and diffuse from the light-sensitive material to said nuclei and can fix the reduced silver halide to said nuclei. As the physical development nuclei are cited heavy metal such as zinc, mercury, lead, cadmium, iron, chrome, nickel, tin, cobalt, copper and terbium, noble metal such as paladium, platinum, silver and gold, and colloidal particles of the chalcogen compounds consisting of these metals and suifer, selenium and tellurium.

EXAMPLES

The invention is described below referring example, an embodiment of the invention is not limited thereto.

Example 1

A silver halide emulsion containing the following silver halide grain was prepared. To 300 ml of a 2.0 wt. % of gelatin aqueous solution containing 0.002 mol adenine were added 500 ml of a mol silver nitrate aqueous solution and 500 ml of an aqueous solution containing three kinds of sodium chloride, potassium bromide and potassium iodide (the amount of halide is a mol in total, Cl; 30 mol %, Br; 68 mol %, I; 2 mol %) by double jet method at 38° C. for 48 min. under stirring. Thus, the silver halide grain was formed.

During forming the above mentioned silver halide grain, the electric potential (pAg) and pH were maintained at 8.0 and 2.0 respectively.

After the formation of the silver grain, the solution containing thus obtained silver halide grain was desalted and then to this silver halide grain was added 300 ml of water and 32 g of gelatin. The pAg and pH of the above obtained silver halide aqueous solution were controlled at 7.5 and 5.5 respectively. Thus obtained silver halide emulsion was subjected to chemical sensitization at 65° C. for 48 min. by adding $3.3\times10^{-6}$ mol auric chloride acid and $4\times10^{-6}$ mol sodium thiosulfate. Thereafter, to this emulsion was added $1.5\times10^{-3}$ mol 4-hydroxy-6-methyl-1,3,3a,7-tetrazaindane (stabilizer) per a mol silver. Then to the above obtained emulsion was added $1.6\times10^{-4}$ mol of the following ortho spectral sensitizing dye (A) and $3.3\times10^{-5}$ of the following ortho spectral sensitizing dye (B) per a mol silver respectively and after these dyes were adsorbed by silver halide, to the above obtained emulsion was added $1.5\times10^{-3}$ mol 4-hydroxy-6-methyl-1,3,3a,7-tetrazaindane (stabilizer) per a mol silver.

Ortho spectral sensitizing dye (A):

Sodium anhydro-5,5'-dichloro-9-ethyl-3,3'-di(3-sulfopropyl)oxacarbocyanine

Ortho spectral sensitizing dye (B):

Anhydro-5,5'-ditrifluoromethyl-1-ethyl-1'-vinyl-3-ethyl-3'-(3-sulfopropyl)-benzimidazolocarbocyaninehydroxide Thus obtained emulsion was coated on polyethylene terephthalate support which comprising B. G. R. mosaic filter layers each having area of 5×5 μm prepared by the method described in example 2 of JP-A 9-145909. The coated amount of silver was 3.0 g/$m^2$. Thus sample No.1 was obtained. Further protective layer comprising gelatin (0.8 g/$m^2$) containing matting agent of silicon oxide of average particle diameter of 3 μm was coated. Furthermore, intermediate layer was interposed between the emulsion layer and protective layer, and emulsion under layer was provided under the emulsion layer. The coated amounts of gelatin in intermediate layer and emulsion under layer were 0.5 g/$m^2$ respectively.

Sample No.2 was prepared in the same way in which sample No.1 was obtained except adding 40 mg/$m^2$ of 4,4-dimethyl-1-phenyl-3-pyrazolidone in the emulsion layer.

Sample No.3 was prepared in the following way.

(Preparation of silver behenate)

18.1 g of behenic acid was dissolved in 120 ml of toluene at 80° C. To this solution was added 1120 ml of distilled water of 70° C. and thus obtained mixture was emulsified by homomixer. The temperature of the mixture was lowered to 40° C. while stirring, then to the mixture was added 3.56 ml of 25% aqueous ammonium solution.

Further, to thus obtained mixture was added 80 ml of distilled water containing 8.10 g of silver nitrate and 0.35 g of gallium nitrate while stirring. After stirring at 50° C. for 15 min., the temperature of the mixture was lowered to 23° C. so that the reaction was over.

Thus white crystal was obtained by filtration, then the crystal was washed by mixture of methyl alcohol and water and obtained by filtration. After this handling was repeated three times, the crystal was dried in oven at 42° C. all day, then 20.1 g of white fine crystal of behenic acid was obtained.

(Preparation of coating solution)

| | |
|---|---|
| Polyvinyl butyral | 4 g |
| Silver behenate (above obtained one) | 3.2 g |
| Behenic acid | 1.6 g |
| Homophthalic acid | 0.6 g |
| Silver bromide (100) plane, particle diameter of 0.08 μm | 0.3 g |
| Azelaic acid | 0.2 g |
| Phthaladinone | 0.4 g |
| 2,2'-methylenebis(4-methyl-6-t-butylphenol) | 2.4 g |
| Xylene | 25 g |
| n-Butyl alcohol | 25 g |
| Dye a | 0.03 g |

(Dye a was dissolved in 5 ml of dimethyl formamide)

The obtained coating solution was coated on the same support which comprising B. G. R. mosaic filter layers as used in preparing sample No.1 in thickness of 10 μm, then protective layer consisting of polyvinyl alcohol was coated on it in thickness of 2 μm.

Dye a

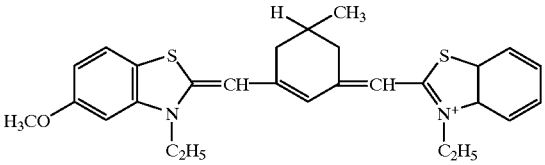

After each sample was cutted in 135 negative film size, perforated, and loaded in a camera, a person and a Macbeth chart were photographed by using each sample. Using Polachrome CS film (produced by Polaroid Co., Ltd) as a comparative sample, similar photographing was carried out. After exposed each sample was processed as shown Table 1, image information was read by film scanner DUO scan (produced by Agfa Co., Ltd), thereafter the image information was processed on personal computer, then the image information was printed out by printer PM-700C (produced by Epson Co., Ltd). The obtained quality of the image was evaluated by a visual observation and classified into four as shown in Table 1. Each processing solution was provided by slit nozzle in an amount of 50 ml/m$^2$.

(Solution I (developer))

| | |
|---|---|
| 1-phenyl-3-pyrazolidone | 3 g |
| Isoascorbic acid | 130 g |
| 5-nitroindazole | 0.25 g |
| 1-phenyl-5-mercaptotetrazole | 0.06 g |
| 5-methylbenzotriazole | 0.06 g |
| 2-mercaptobenzimidazole-5-sulfonic acid | 0.3 g |
| Potassium bromide | 3.0 g |
| Sodium sulfite | 50 g |
| Potassium hydroxide | 30 g |
| Boric acid | 10 g |
| N-n-butyldiethanolamine | 15 g |
| Ethylenediamine disuccinic acid diacetic acid | 1.0 g |

Water was added to make 1 liter in total, and the pH was adjusted to 10.20.

(Solution II (developer-fixer))

| | |
|---|---|
| Sodium thiosulfate | 150 g |
| 1-phenyl-3-pyrazolidone | 3 g |
| Isoascorbic acid | 130 g |
| 5-nitroindazole | 0.25 g |
| 1-phenyl-5-mercaptotetrazole | 0.06 g |
| 5-methylbenzotriazole | 0.06 g |
| 2-mercaptobenzimidazole-5-sulfonic acid | 0.3 g |
| Potassium bromide | 3.0 g |
| Sodium sulfite | 50 g |
| Potassium hydroxide | 30 g |
| Boric acid | 10 g |
| N-n-butyldiethanolamine | 15 g |
| Ethyienediamine disuccinic acid diacetic acid | 1.0 g |

Water was added to make 1 liter in total, and the pH was adjusted to 10.20.

(Solution III (activation solution))

| | |
|---|---|
| 5-nitroindazole | 0.25 g |
| 1-phenyl-5-mercaptotetrazole | 0.06 g |
| 5-methylbenzotriazole | 0.06 g |
| 2-mercaptobenzimidazole-5-sulfonic acid | 0.3 g |
| Potassium bromide | 3.0 g |
| Sodium sulfite | 50 g |
| Potassium hydroxide | 30 g |
| Boric acid | 10 g |
| N-n-butyldiethanolamine | 15 g |
| Ethylenediamine disuccinic acid diacetic acid | 1.0 g |

Water was added to make 1 liter in total, and the pH was adjusted to 11.0.

(Solution IV (Activator-fixer Solution))

| | |
|---|---|
| Sodium thiosulfate | 150 g |
| 5-nitroindazole | 0.25 g |
| 1-phenyl-5-mercaptotetrazole | 0.06 g |
| 5-methylbenzotriazole | 0.06 g |
| 2-mercaptobenzimidazole-5-sulfonic acid | 0.3 g |
| Potassium bromide | 3.0 g |
| Sodium sulfite | 50 g |
| Potassium hydroxide | 30 g |
| Boric acid | 10 g |
| N-n-butyldiethanolamine | 15 g |
| Ethylenediamine disuccinic acid diacetic acid | 1.0 g |

Water was added to make 1 liter in total, and the pH was adjusted to 11.0.

TABLE 1

| No. | Sample No. | Processing solution | Processing temperature | Processing time | Image quality | Remarks |
|---|---|---|---|---|---|---|
| 1 | Comaparative sample | I | 40 | 15 sec. | C | Comp. |
| 2 | Comaparative sample | II | 40 | 20 sec. | C | Comp. |
| 3 | Comaparative sample | III | 60 | 10 sec. | D | Comp. |
| 4 | Comaparative sample | IV | 60 | 15 sec. | D | Comp. |
| 5 | 1 | I | 40 | 15 sec. | B | Inv. |
| 6 | 1 | II | 40 | 20 sec. | A | Inv. |
| 7 | 2 | III | 60 | 10 sec. | B | Inv. |
| 8 | 2 | IV | 60 | 15 sec. | A | Inv. |
| 9 | 3 | Did not use | 120 | 5 sec. | B | Inv. |

A; Very good,
B; good,
C; Insufficient,
D; Image was not obtained
Comp.; Comparison,
Inv.; Invention As can be seen from Table 1, No.1 and No.2 in which comparative sample, Polachrome CS film was employed, exhibited insufficient image quality. No.3 and No.4 in which comparative sample, Polachrome CS film was also employed, exhibited no image because of no developer being incorporated in Polachrome CS film. However, No.5 to No.9 according to the present invention exhibited good image quality in spite of very short processing time.

An experimental relating to item 8 to item 15 is described below.

Experimental 1

A silver halide emulsion containing the following silver halide grain was prepared. To 300 ml of a 2.0 wt. % of gelatin aqueous solution containing 0.002 mol adenine was added 500 ml of a mol silver nitrate aqueous solution and 500 ml of an aqueous solution containing three kinds of sodium chloride, potassium bromide and potassium iodide (the amount of halide is a mol in total, Cl; 30 mol %, Br; 68 mol %, I; 2 mol %) by double jet method at 38° C. for 48 min. under stirring. Thus, the silver halide grain was formed.

During forming the above mentioned silver halide grain, the electric potential (pAg) and pH were maintained at 8.0 and 2.0 respectively.

After the formation of the silver grain, the solution containing thus obtained silver halide grain was desalted and then to this silver halide grain was added 300 ml of water and 32 g of gelatin. The pAg and pH of the above obtained silver halide aqueous solution were controlled at 7.5 and 5.5 respectively. Thus obtained silver halide emulsion was subjected to chemical sensitization at 65° C. for 48 min. by adding $3.3\times10^{-6}$ mol auric chloride acid and $4\times10^{-6}$ mol sodium thiosulfuric acid. Thereafter, to this emulsion was added $1.5\times10^{-3}$ mol 4-hydroxy-6-methyl-1,3,3a,7-tetrazaindane (stabilizer) per a mol silver. Then to the above obtained emulsion was added $1.6\times10^{-4}$ mol of the following ortho spectral sensitizing dye (A) and $3.3\times10^{-5}$ of the following ortho spectral sensitizing dye (B) per a mol silver respectively and after these dyes were adsorbed by silver halide, to the above obtained emulsion was added $1.5\times10^{-3}$ mol 4-hydroxy-6-methyl-1,3,3a,7-tetrazaindane (stabilizer) per a mol silver.

Ortho spectral sensitizing dye (A):

Sodium anhydro-5,5'-dichloro-9-ethyl-3,3'-di(3-sulfopropyl)oxacarbocyanine

Ortho spectral sensitizing dye (B):

Anhydro-5,5'-ditrifluoromethyl-1-ethyl-1'-vinyl-3-ethyl-3'-(3-sulfopropyl)-benzimidazolocarbocyaninehydroxide Further, to the above obtained emulsion was added 4,4-dimethyl-1-phenyl-3-pyrazolidone in an amount of 200 mg/m$^2$.

Thus obtained emulsion was coated on polyethylene terephthalate support which comprising B. G. R. mosaic filter layers each having area of 5×5 $\mu$m prepared by the method described in example 2 of JP-A 9-145909. The coated amount of silver was 3.0 g/m$^2$. Thus sample No.11 was obtained. Further, protective layer comprising gelatin (0.8 g/m$^2$) containing matting agent of silicon oxide of average particle diameter of 3 $\mu$m was coated. Furthermore, intermediate layer was interposed between the emulsion layer and protective layer, and emulsion under layer was provided under the emulsion layer. The coated amounts of gelatin in intermediate layer and emulsion under layer were 0.5 g/m$^2$ respectively.

Sample No.12 was prepared in the same way in which sample No.11 was obtained except adding solid dispersion of 1.2 g/m$^2$ of zinc hydroxide in the protective layer.

After each sample was cutted in 135 negative film size, perforated, and loaded in a camera, a person and a Macbeth chart were photographed by using each sample. Using Polachrome CS film (produced by Polaroid Co., Ltd) as a comparative sample, similar photographing was carried out. After exposed each sample was processed as shown Table 3, image information was read by film scanner DUO scan (produced by Agfa Co., Ltd), thereafter the image information was processed on personal computer, then the image information was printed out by printer PM-700° C. (produced by Epson Co., Ltd). The obtained quality of the image was evaluated by a visual observation and classified into four as shown in Table 3. Each processing solution was provided by slit nozzle in an amount of 50 ml/m$^2$.

(Solution I (alkaline activator))

| | |
|---|---|
| Isoascorbic acid | 130 g |
| 5-nitroindazole | 0.25 g |
| 1-phenyl-5-mercaptotetrazole | 0.06 g |
| 5-methylbenzotriazole | 0.06 g |
| 2-mercaptobenzimidazole-5-sulfonic acid | 0.3 g |
| Potassium bromide | 3.0 g |
| Sodium sulfite | 50 g |
| Potassium hydroxide | 30 g |
| Boric acid | 10 g |
| N-n-butyldiethanolamine | 15 g |
| Ethylenediamine disuccinic acid diacetic acid | 1.0 g |

Water was added to make 1 liter in total, and the pH was adjusted to 10.20.

(Solution II (developer-fixer))

| | |
|---|---|
| Sodium thiosulfate | 150 g |
| Isoascorbic acid | 130 g |
| 5-nitroindazole | 0.25 g |
| 1-phenyl-5-mercaptotetrazole | 0.06 g |
| 5-methylbenzotriazole | 0.06 g |
| 2-mercaptobenziinidazole-5-sulfonic acid | 0.3 g |
| Potassium bromide | 3.0 g |

-continued

| | |
|---|---|
| Sodium sulfite | 50 g |
| Potassium hydroxide | 30 g |
| Boric acid | 10 g |
| N-n-butyldiethanolamine | 15 g |
| Ethylenediamine disuccinic acid diacetic acid | 1.0 g |

Water was added to make 1 liter in total, and the pH was adjusted to 10.20.

(Solution III (activation solution))

| | |
|---|---|
| Picolic acid guanidine | 10 g |
| 5-nitroindazole | 0.25 g |
| 1-phenyl-5-mercaptotetrazole | 0.06 g |
| 5-methylbenzotriazole | 0.06 g |
| 2-mercaptobenzimidazole-5-sulfonic acid | 0.3 g |
| Potassium bromide | 3.0 g |
| Sodium sulfite | 50 g |
| Boric acid | 10 g |
| N-n-butyldiethanolamine | 15 g |
| Ethylenediamine disuccinic acid diacetic acid | 1.0 g |

Water was added to make 1 liter in total, and the pH was adjusted to 7.0.

(Solution IV (activator-fixer solution))

| | |
|---|---|
| Picolic acid guanidine | 10 g |
| Sodium thiosulfate | 150 g |
| 5-nitroindazole | 0.25 g |
| 1-phenyl-5-mercaptotetrazole | 0.06 g |
| 5-methylbenzotriazole | 0.06 g |
| 2-mercaptobenzimidazole-5-sulfonic acid | 0.3 g |
| Potassium bromide | 3.0 g |
| Sodium sulfite | 50 g |
| Boric acid | 10 g |
| N-n-butyldiethanolamine | 15 g |
| Ethylenediamine disuccinic acid diacetic acid | 1.0 g |

Water was added to make 1 liter in total, and the pH was adjusted to 7.0.

(Preparing processing material (processing sheet), R-1)

The following four layers each containing composition as shown below were coated on support A (thickness of 63 $\mu$m). The addition amount of each compound was represented in term of g/m$^2$.

| | |
|---|---|
| 1st Layer: (Sublayer) | |
| Alkali processed gelatin | 280 |
| Water soluble polymer (19) | 12 |
| Surfactant (9) | 14 |
| Hardener (25) | 185 |
| 2nd Layer: (Fixer containing layer) | |
| Alkali processed gelatin | 2400 |
| Water soluble polymer (20) | 360 |
| Water soluble polymer (26) | 700 |
| Water soluble polymer (27) | 600 |
| High boiling solvent (28) | 2000 |
| Additives (29) | 20 |
| Hydantoin potassium | 260 |
| Quinolic acid potassium | 225 |
| Quinolic acid sodium | 180 |
| Surfactant (7) | 24 |
| 3rd Layer: (Intermediate layer) | |
| Alkali processed gelatin | 240 |
| Water soluble polymer (20) | 24 |
| Hardener (25) | 180 |
| Surfactant (7) | 9 |

-continued

| | |
|---|---|
| 4th Layer: (Protective layer) | |
| Acid processed gelatin | 220 |
| Water soluble polymer (19) | 60 |
| Water soluble polymer (20) | 200 |
| Additives (21) | 80 |
| Palladium sulfide | 3 |
| Potassium nitrate | 12 |
| Matting agent (22) | 10 |
| Surfactant (9) | 7 |
| Surfactant (23) | 7 |
| Surfactant (24) | 10 |

Further, the processing material (processing sheet), R-2 was prepared in the same way in which the processing material (processing sheet), R-1 was prepared except adding 3 g/m$^2$ of Picolic acid guanidine in 2nd layer.

TABLE 2

Layer structure of support

| Layer | Composition | Weight (mg/m$^2$) |
|---|---|---|
| Surface sublayer | Alkali processed gelatine | 100 |
| Polymer layer | Polyethylene terephathalate | 62,500 |
| Black surface sublayer | Polymer (copolymer consisting of methglmethacrylate-styrene-2-ethylhexylacrylate-methacrylate | 1,000 |
| | PMMA latex | 120 |

Water soluble polymer (19): κ-carrageenan

Water soluble polymer (20): Sumikagel-5H (produced by Sumitomo Chemical Co., Ltd.)

Additives (21)

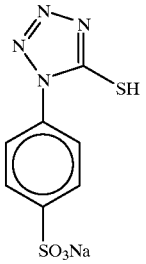

Matting agent (22)

SYLOID79 (produced by Fuji Devisson Co., Ltd.)

Surfactant (7)

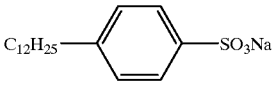

Surfactant (9)

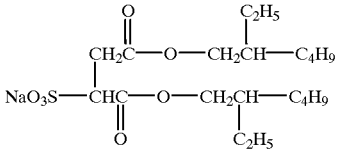

Surfactant (23)

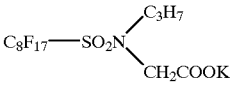

-continued

Surfactant (24)

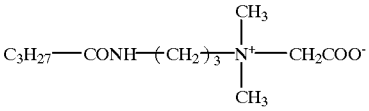

Hardener (25)

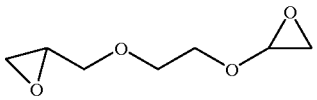

Additives (29)

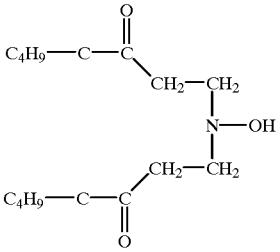

TABLE 3

| No. | Sample No. | Process* | Processing time | Image quality |
|---|---|---|---|---|
| 11 | 11 | 1 | 15 sec. | B |
| 12 | 11 | 2 | 20 sec. | A |
| 13 | 11 | 3 | 25 sec. | A |
| 14 | 12 | 4 | 15 sec. | B |
| 15 | 12 | 5 | 20 sec. | A |
| 16 | 12 | 6 | 25 sec. | A |

TABLE 3-continued

| No. | Sample No. | Process* | Processing time | Image quality |
|---|---|---|---|---|
| 17 | 12 | 7 | 20 sec. | A |
| 18 | Comparative material | 1 | 30 sec. | C |

A; Very good, B; Good, C; Insufficient

*Processing method

Process 1; processing by solution I, 50° C., 15 sec.

Process 2; processing by solution II, 50° C., 20 sec.

Process 3; after processing by solution I, 50° C., 15 sec., piling processing sheet R-1, 50° C., 10 sec., then R-1 was peeled apart.

Process 4; processing by solution III, 50° C., 15 sec.

Process 5; processing by solution IV, 50° C., 20 sec.

Process 6; after processing by solution III, 50° C., 15 sec., piling R-1, 50° C., 10 sec., then R-1 peeled was apart.

Process 7; piling R-2, 50° C., 20 sec., then R-2 peeled apart.

As can be seen from Table 3, No.18 in which comparative sample, Polachrome CS film was employed, exhibited insufficient image quality. However, No.11 to No.17 according to the present invention exhibited good image quality in a very short processing time.

What is claimed is:

1. A method for processing a silver halide photographic light-sensitive material containing at least one silver halide emulsion layer and mosaic-like or stripe-like filter layer having at least three spectral transmission characteristics comprising the step of exposing the silver halide emulsion layer, and developing the exposed silver halide emulsion layer by coating or spraying a processing solution containing at least one developing agent so as to obtain a developed image.

2. The method of claim 1, further comprising:

scanning the developed image, and converting the developed image into a digital information.

3. The method of claim 1, wherein the processing solution contains at least one fixing agent.

4. The method of claim 2, wherein the processing solution contains at least one fixing agent.

* * * * *